US007040373B2

(12) United States Patent
Snyder

(10) Patent No.: US 7,040,373 B2
(45) Date of Patent: May 9, 2006

(54) EXTRUDED DOOR PANEL MEMBERS

(75) Inventor: Ronald P. Snyder, Peosta, IA (US)

(73) Assignee: Rite-Hite Holding Corp., Milwaukee, WI (US)

( * ) Notice: Subject to any disclaimer, the term of this patent is extended or adjusted under 35 U.S.C. 154(b) by 0 days.

(21) Appl. No.: 10/617,533

(22) Filed: Jul. 11, 2003

(65) Prior Publication Data

US 2004/0079494 A1 Apr. 29, 2004

Related U.S. Application Data

(63) Continuation-in-part of application No. 09/956,620, filed on Sep. 19, 2001, now Pat. No. 6,655,442.

(51) Int. Cl.
*E05D 15/06* (2006.01)

(52) U.S. Cl. ..... 160/113; 160/92; 49/464

(58) Field of Classification Search ..... 160/201, 160/232, 236, 229.1, 133, 40, 405, 113, 92; 49/464, 463; 52/71, 589.1, 592.1, 578
See application file for complete search history.

(56) References Cited

U.S. PATENT DOCUMENTS

| | | | | |
|---|---|---|---|---|
| 2,926,729 | A | 3/1960 | Zanini | 160/236 |
| 2,951,533 | A | 9/1960 | Lucas et al. | 160/40 |
| 3,178,776 | A * | 4/1965 | Stansberry | 52/456 |
| 3,247,637 | A | 4/1966 | Robertson | 52/588 |
| 3,302,690 | A | 2/1967 | Hurd | 160/40 |
| 3,980,123 | A | 9/1976 | Vago | 160/201 |
| 3,992,839 | A * | 11/1976 | La Borde | 52/275 |
| 4,432,591 | A | 2/1984 | Rinkewich | 312/297 |
| 4,569,383 | A | 2/1986 | Wentzel | 160/201 |
| 4,924,932 | A | 5/1990 | Esnault | 160/201 |
| 5,060,711 | A | 10/1991 | Fimbell | 160/229.1 |
| 5,170,832 | A | 12/1992 | Wagner | 160/201 |
| 5,265,663 | A | 11/1993 | Munekata et al. | 160/235 X |
| 5,315,798 | A * | 5/1994 | Zarwell | 52/202 |
| 5,445,206 | A | 8/1995 | Shepard | 160/201 |
| 5,445,208 | A | 8/1995 | Shanner | 160/232 |
| 5,553,651 | A | 9/1996 | Olsen | 160/235 |
| 5,555,923 | A | 9/1996 | Leist | 160/229.1 |
| 5,718,276 | A | 2/1998 | Rekret | 160/201 |
| 5,911,660 | A * | 6/1999 | Watson | 52/202 |
| 5,915,446 | A | 6/1999 | De Zen | 160/235 |
| 6,041,846 | A | 3/2000 | Langlois | 160/201 |
| 6,041,847 | A | 3/2000 | Lai | 160/236 |
| 6,098,696 | A | 8/2000 | Styra | 160/201 |
| 6,295,778 | B1 * | 10/2001 | Burt | 52/592.6 |
| 6,655,442 | B1 * | 12/2003 | Snyder | 160/201 |
| 6,739,106 | B1 * | 5/2004 | Curatolo | 52/592.1 |
| 2003/0205340 | A1 | 11/2003 | Nadar | |

OTHER PUBLICATIONS

*International Search Report* corresponding to International Application Serial No. PCT/02/29655, dated Apr. 4, 2003, ISA/US.

* cited by examiner

*Primary Examiner*—David Purol
(74) *Attorney, Agent, or Firm*—Hanley, Flight & Zimmerman, LLC

(57) ABSTRACT

A door panel comprises several interlocking panel members. The panel members can be extrusions that are readily cut to length to create assembled door panels that match doorways of various widths. The ability to readily provide a door panel in various widths and lengths makes such a panel particularly useful as a replacement panel whose size needs to match that of existing door panels. In some embodiments, a physical property of the panel member's extruded material varies from one panel member to another and/or varies within a single panel member to provide a door panel with certain desirable characteristics.

63 Claims, 6 Drawing Sheets

FIG. 2
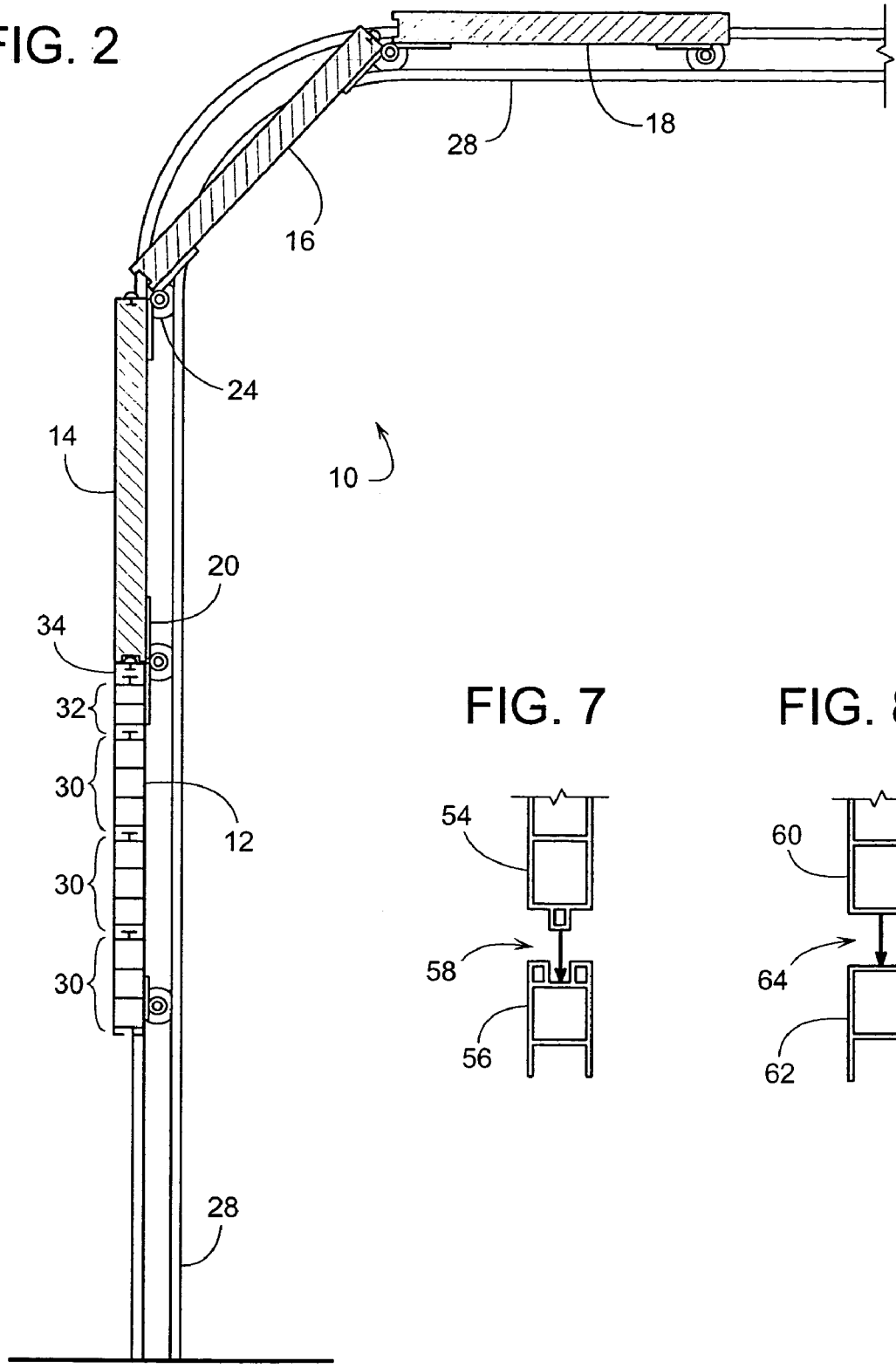
FIG. 7
FIG. 8
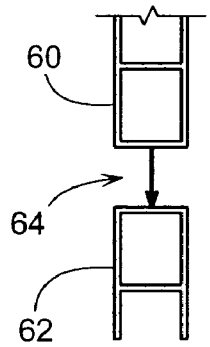

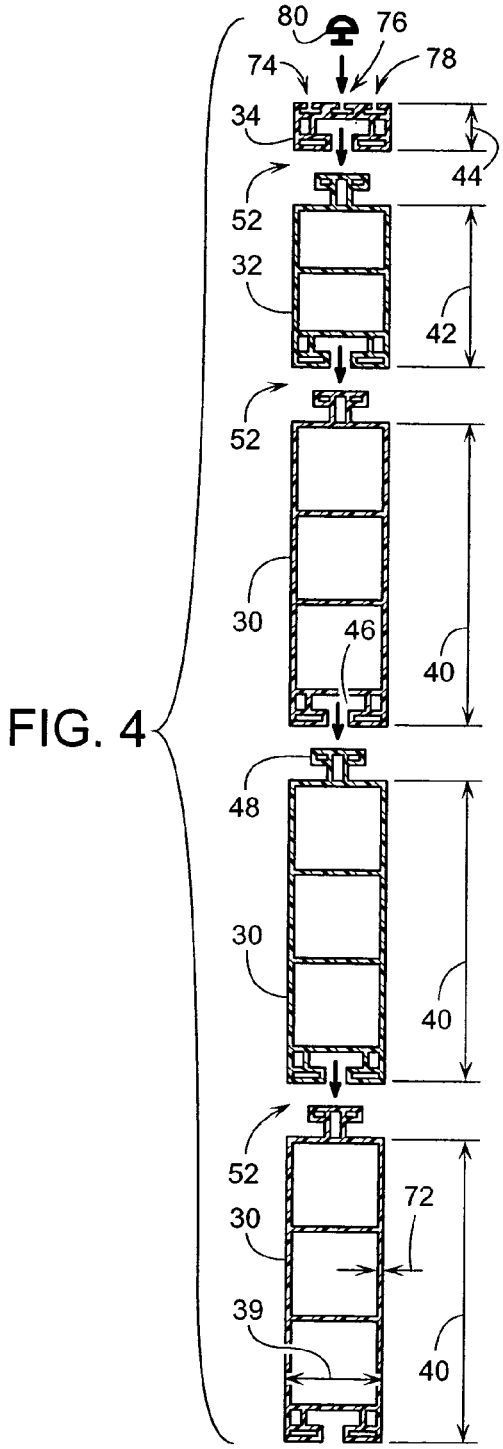
FIG. 4
FIG. 5
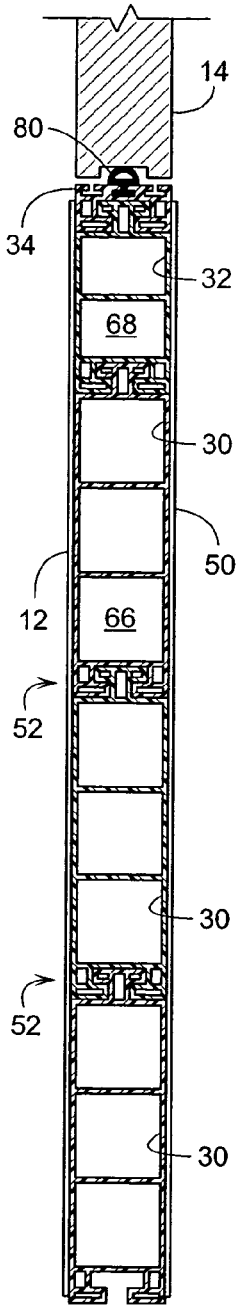
FIG. 6
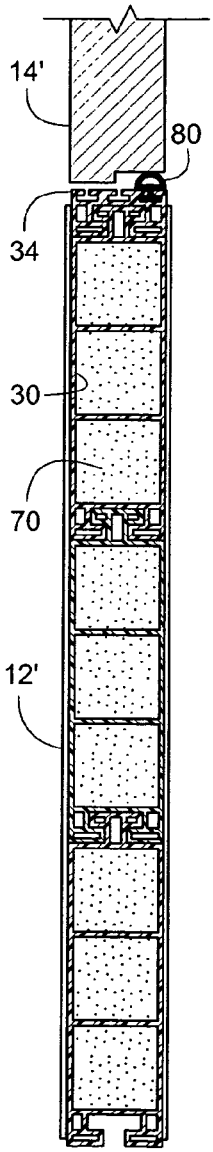

FIG. 11
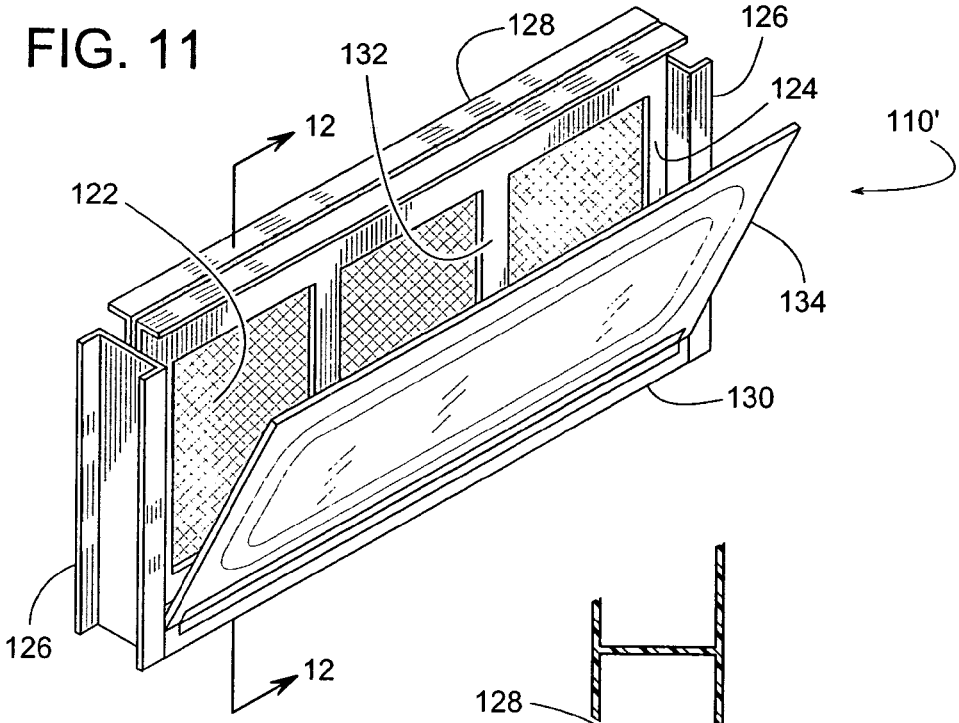
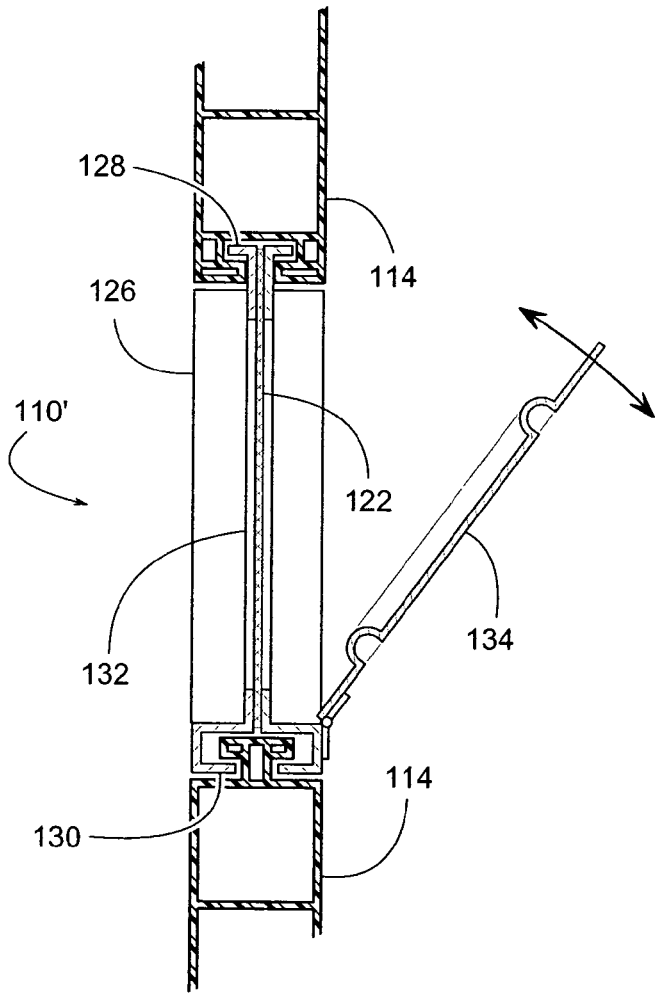
FIG. 12

EXTRUDED DOOR PANEL MEMBERS

RELATED APPLICATIONS

This application is a Continuation-in-Part of U.S. patent application Ser. No. 09/956,620, filed Sep. 19, 2001, now U.S. Pat. No. 6,655,442.

BACKGROUND OF THE INVENTION

1. Field of the Invention

The subject invention generally pertains to doors and more specifically to a door panel with extruded panel members.

2. Description of Related Art

Almost any type of door can be struck by a vehicle either intentionally or by accident. However, some doors can withstand an impact better than others. For example, impact doors are freely swinging doors that are opened by intentionally striking and pushing the door open with a vehicle, such as a forklift or other type of material handling equipment. Impact doors are usually made of particularly tough materials to endure repeated hits. Such doors are also preferably as light as possible to minimize inertial forces that develop during impact. Unfortunately, reducing a door's weight without sacrificing its toughness can be difficult to achieve.

Sectional doors are also susceptible to being struck by a vehicle, although in this case the collisions are usually unintentional. A sectional door typically includes a series of panels whose adjacent horizontal edges are each pivotally connected by a row of hinges. As the door opens or closes, the door panels travel along two lateral tracks that in one configuration curve between horizontal and vertical. To close the door, the tracks guide the panels to a vertical position. When the door opens, the hinges allow the panels to curve around onto horizontal sections of the tracks, where the door panels store horizontally overhead. In other configurations, the sectional door maintains a generally vertical, planar configuration and is stored more directly above the doorway. Such doors, regardless of their configuration, can be powered up or down or can be manually operated. To ease the operation of the door, a torsion spring is often used to offset the weight of the door panels. Sectional doors are commonly used as residential garage doors; however, they are also often used in warehouses and other industrial buildings.

When used in high-traffic industrial applications, sectional doors are very susceptible to being struck by large trucks, trailers, forklifts and other vehicles. Collisions are often caused by a door's torsion spring becoming weak with age or not being properly preloaded, which can allow a door to droop into the doorway by not opening fully. Consequently, an upper edge of a vehicle may catch the lowest panel of the door, which often breaks or destroys just that panel.

To avoid having to repeatedly replace the lowest panel with an identical one (or indeed any panel on a door, as panels beside the lower-most one get damaged), a more impact-resistant panel can be used as a replacement, such as a panel that is tougher and more flexible. However, to do so, the replacement panel should be about the same size as the one being replaced. The replacement panel should also have a seal member whose shape and location is suitable for sealing against an existing door panel. Providing such a replacement door panel can be difficult to do, because of the different types of seals and the wide range of existing door panel sizes. A panel design whose length, width or seal configuration is riot readily altered would generally require a large inventory of panels to meet the requirements of numerous door applications.

Some door panels have metal frames with sheet metal skins. Such construction features can make a door panel difficult to shorten or lengthen (along the width of the doorway) to match the existing panels. Such features also make it difficult to change a door panel's width (vertical dimension when the door is closed).

Other door panels may perhaps be extruded, such as those of U.S. Pat. Nos. 5,718,276; 5,445,206; 5,170,832; 4,979,553; 4,924,932; 4,432,591 and 3,247,637. Extruded panels may be relatively easy to cut to length (i.e., doorway width); however, their width and seal geometry is generally fixed. It's conceivable that interconnecting a series of relatively narrow panels could create doors and/or individual panels having various accumulated heights. However, with current designs, flexing between each adjacent panel means each individual panel may need to have its own means for guiding itself along the track. Since each additional guide member contributes drag to the door's movement, a door with numerous narrow panels may be more difficult to open and close than a door with fewer panels. The problem of drag not only applies to doors whose bottom panel is replaced, but also applies to all doors including new door construction.

Consequently, there is a need to be able to manufacture replacement door panels as well as entire doors for doorways of various width and height, and to be able to do so without having to manufacture and stock numerous door panels of various sizes and seal geometries.

In addition, most current sectional door panels share the feature of having a monolithic design. For example, a common design of such a monolithic panel is a formed metal "pan" with a fairly complex profile, and to which hinges and roller hardware are attached. Other examples of a monolithic design are panels with a rigid frame structure and including filler material within the frame and facing panels on the exterior surfaces. Yet, another example is found in U.S. Pat. No. 2,951,533, which discloses a panel comprised of glued-together components (see col 4, lines 17–23 of the patent). Because of such monolithic designs, damage to any given portion of such a panel (particularly damage that would negatively impact the operability of the door) requires replacement of the entire panel. There is currently not a practical way to be able to replace only a damaged section of an individual panel, as opposed to the entire panel itself.

The monolithic nature of current panels also prevents the possibility of being able to easily provide variability of material properties within a given panel, as may be advantageous depending on the application for the panel. For example, it may be that in a given application, a particular area of the panel (illustratively, the lowermost third) is more susceptible to impact. In such an application, it would be desirable for that area of the panel to be more resistant to impact than the rest of the panel, without having to form the entire panel out of the (typically more expensive) impact-resistant material. For a monolithic panel, this could only be achieved by adding material or structure to the panel in that particular area. A more flexible approach would be to provide for a non-monolithic design wherein the desired material property for a given area of the panel could be easily provided and preferably easily modified according to the application.

SUMMARY OF THE INVENTION

In some embodiments, a sectional door is provided with several panel members with at least one panel member having more freedom to pivot relative to a first adjacent panel orpanel-member than it is able pivot relative to a second adjacent panel member.

In some embodiments, one panel member is substantially fixed to a first adjacent panel member, but is able to pivot relative to a second adjacent panel or panel member.

In some embodiments, a door panel comprises a series of extruded panel members

In some embodiments, a sectional door is provided with a door panel comprising several panel members of various widths.

In some embodiments, a door panel is comprised of several interlocking panel members, wherein the panel members can hold themselves to each other without additional hardware or adhesive.

In some embodiments, a door panel member is provided with a hollow interior, so the panel can be readily extruded.

In some embodiments, a door panel member is provided with a hollow interior, so the panel can be filled with thermal insulation.

In some embodiments, a seal member can be attached to a door panel member at alternate locations, so the resulting panel can serve as a replacement panel for existing doors of various seal designs.

In some embodiments, a door panel comprises a set of interlocking panel members that are reinforced by two end caps, wherein the end caps facilitate the mounting of various door hardware.

In some embodiments, a door panel is made of door panel members of plastic for flexibility and includes a hinge made of steel for strength.

In some embodiments, a sectional door includes a door panel of a transparency ranging from transparent to opaque.

In some embodiments, two modular panel members interlock to create a substantially planer door panel.

In some embodiments, a generally planar door panel includes two distinguishable modular panel members that are vertically offset relative to each other.

In some embodiments, a generally planar door panel includes two distinguishable modular panel members that are horizontally offset relative to each other.

In some embodiments, a door panel includes two modular panel members, wherein one panel member is distinguishable from the other by its material property.

In some embodiments a door panel includes two interconnected modular panel members that are distinguishable from each other by way of at least one material property, wherein the material property may be toughness (impactability), flexibility, tensile strength, hardness, wear resistance, ability to transmit light, color, ultraviolet light tolerance, surface finish, water resistance, range of temperature tolerance, thermal conductivity, and/or bonding ability.

In some embodiments a door panel includes two interconnected modular panel members, wherein one of the panel members includes a screen.

In some embodiments of an extruded door panel, the extruded material has a material property that various within the panel, wherein the material property may be toughness (impactability), flexibility, tensile strength, hardness, wear resistance, ability to transmit light, color, ultraviolet light tolerance, surface finish, water resistance, range of temperature tolerance, thermal conductivity, and/or bonding ability.

In some embodiments, a door panel is created by determining a desired characteristic of a particular door panel, extruding a plurality of panels whose material properties vary from one panel to another, and selecting from the plurality of panels based on the desired characteristic of the particular door panel.

BRIEF DESCRIPTION OF THE DRAWINGS

FIG. 2 is a cross-sectional view taken along line 2—2 of FIG. 1.

FIG. 4 is a cross-sectional end view in an exploded arrangement showing various parts of a door panel used in the door of FIG. 1.

FIG. 5 is a cross-sectional end view of the door panel of FIG. 4, but shown assembled and connected to an adjacent door panel having a tongue and groove seal design.

FIG. 6 is a cross-sectional end view similar to FIG. 5, but showing a door panel of a different assembled width and with the door panel connected to an adjacent door panel having a shiplap seal design.

FIG. 7 is a cross-sectional end view of an alternate embodiment of two adjoining panel members.

FIG. 8 is similar to FIG. 7, but showing yet another embodiment of two adjoining panel members.

FIG. 11 is a perspective view of a component panel member that includes a screen.

FIG. 12 is a cross-sectional view taken along line 12—12 of FIG. 11.

DESCRIPTION OF THE PREFERRED EMBODIMENT

Figure 1:
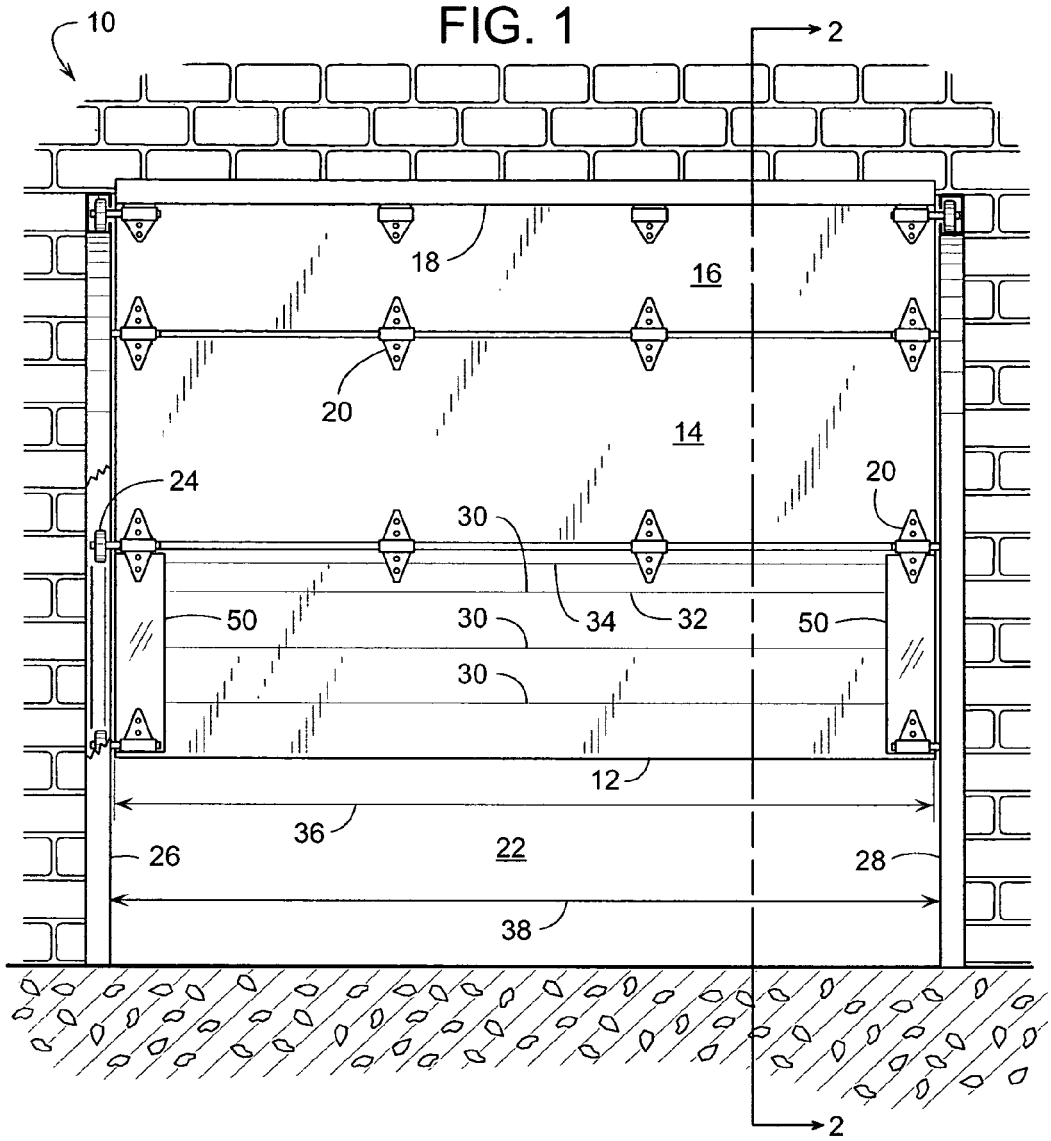
FIG. 1 is a front view of one embodiment of an overhead-storing sectional door in a partially open position, with the door being viewed from inside a building and looking out.

A sectional door 10, shown partially open in FIGS. 1 and 2, includes a series of door panels 12, 14, 16 and 18 that are interconnected along their adjacent horizontal edges by hinges 20. In this description, the term, "panel" describes one of typically four or five sectional door components, each of which is generally planar and hingedly interconnected to panels above and below, except for the top and bottom panels. As door 10 opens or closes relative to a doorway 22, guide members, such as rollers 24, guide the movement of the panels along two lateral tracks 26 and 28. In this example, tracks 26 and 28 curve between horizontal and vertical; however, it is well within the scope of the invention to have tracks 26 and 28 run generally linearly or only curve slightly, so that when the door opens, the door panels move above doorway 22, but remain in a generally vertical or slightly angled orientation. To close door 10, the vertical sections of tracks 26 and 28 guide the panels to a vertical position across doorway 22, as indicated by the positions of panels 12 and 14. When door 10 opens, hinges 20 allow the panels to curve around onto the horizontal sections of tracks 26 and 28, where the door panels store horizontally overhead, as indicated by the position of panel 18.

The actual structure of panels 12, 14, 16 and 18 can vary from one door to another, vary among panels of the same door, or be the same for each panel of the same door and still remain well within the scope of the invention. However, many of the door panel embodiments are especially useful in retrofit applications where a new panel replaces the lowest panel of a door whose original panels are not as impact resistant as the new one. So, a preferred embodiment will be described with reference to door 10 whose lowest panel 12 comprises a set of interconnected panel members 30, 32 and 34 that are relatively tough and impact resistant.

Panel members 30, 32 and 34 can be extruded of PVC in different shapes and sizes, as shown generally in FIGS. 4–6. The panel members can be cut to a particular length 36 that is appropriate for a width 38 of doorway 22 (see FIG. 1), or two or more panel members can be laid end-to-end to create any desired length for other doorways (e.g., see panels 84 and 86 of FIG. 9). A thickness 39 of each of the panel members is generally the same; however, the exposed width of a panel member can vary from one panel member to the next. When referring to a panel member, the term "width" refers to a dimension of the panel member measured along a direction generally parallel to the direction the panel member translates as the door opens or closes. For example, when the door is closed with a panel member lying generally along a vertical plane, the width of the panel member is measured vertically. For door panel 12, the width of panel members 30, 32 and 34 is approximately 6 inches, 3 inches, and 1 inch, as indicated by dimensions 40, 42 and 44, respectively (see FIG. 4). This allows the panel members to be interconnected in various combinations to create door panels of various total widths. In FIG. 5, for example, panel members 30, 32 and 34 provide door panel 12 with a total width of about 22 inches (1+3+6+6+6). In FIG. 6, panel members 30 and 34 provide a door panel 12' whose total width is 19 inches (1+6+6+6).

Figure 3:
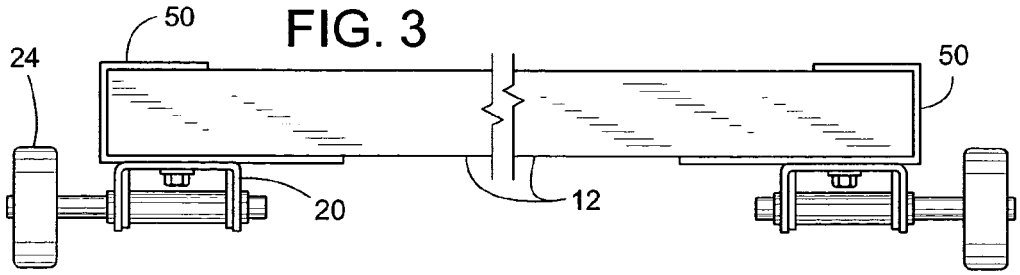
FIG. 3 is a top view of a door panel of in FIG. 1.

To interconnect the panel members, each panel member 30, 32 and 34 includes a T-slot 46 adapted to receive a mating protrusion 48 of an adjacent panel member by sliding protrusion 48 lengthwise into slot 46. T-slot 46 and protrusion 48 can be extruded along with the rest of the panel member to comprise a unitary piece. In some cases, sheet metal end caps 50 (see FIG. 3) can be fastened to each end of door panel 12 to provide panel 12 with greater rigidity and provide a strong surface to which rollers 24 and metal hinges 20 can be attached. Although, T-shaped slots and protrusions are preferred, because they provide the panel members with an interlocking connection 52, other panel-to-panel interfaces are also well within the scope of the invention. For example, in some embodiments, a tongue and groove connection 58 provides an interface between adjacent panels 54 and 56, as shown in FIG. 7. In another embodiment, a butt connection 64 provides an interface between panels 60 and 62, as shown in FIG. 8. With connections 58 and 64, however, additional hardware, such as end caps 50, would be needed to hold the panels together. It should be noted that the top surface of panel member 34 may be generally flat to facilitate a pivotal connection to the adjacent panel 14 or 14'.

Panel members 30 and 32 can have a hollow interior 66 and 68, as shown in FIG. 5, or its interior can be filled with a thermal insulating filler material 70, such as foam, as shown in FIG. 6. Other portions of members 30, 32 and 34 are also hollow to provide a panel member with a relatively thin and substantially uniform material thickness 72. This not only reduces the amount of material required to make a panel member, but also facilitates the use of a conventional plastic extrusion process, wherein softened extruded material is able to solidify at a quick, uniform rate.

To enable door panel 12 to seal against various adjoining panels, such as panel 14 of FIG. 5 or panel 14' of FIG. 6, panel member 12 includes several slots 74, 76 and 78 into which a compliant vinyl seal member 80 can be selectively installed to suit the geometry of the adjoining panel. Seal member 80 installed in slot 76 fits the tongue and groove seal geometry of panel 14, and seal member 80 installed in slot 78 accommodates the shiplap seal design of panel 14'.

Figure 9:
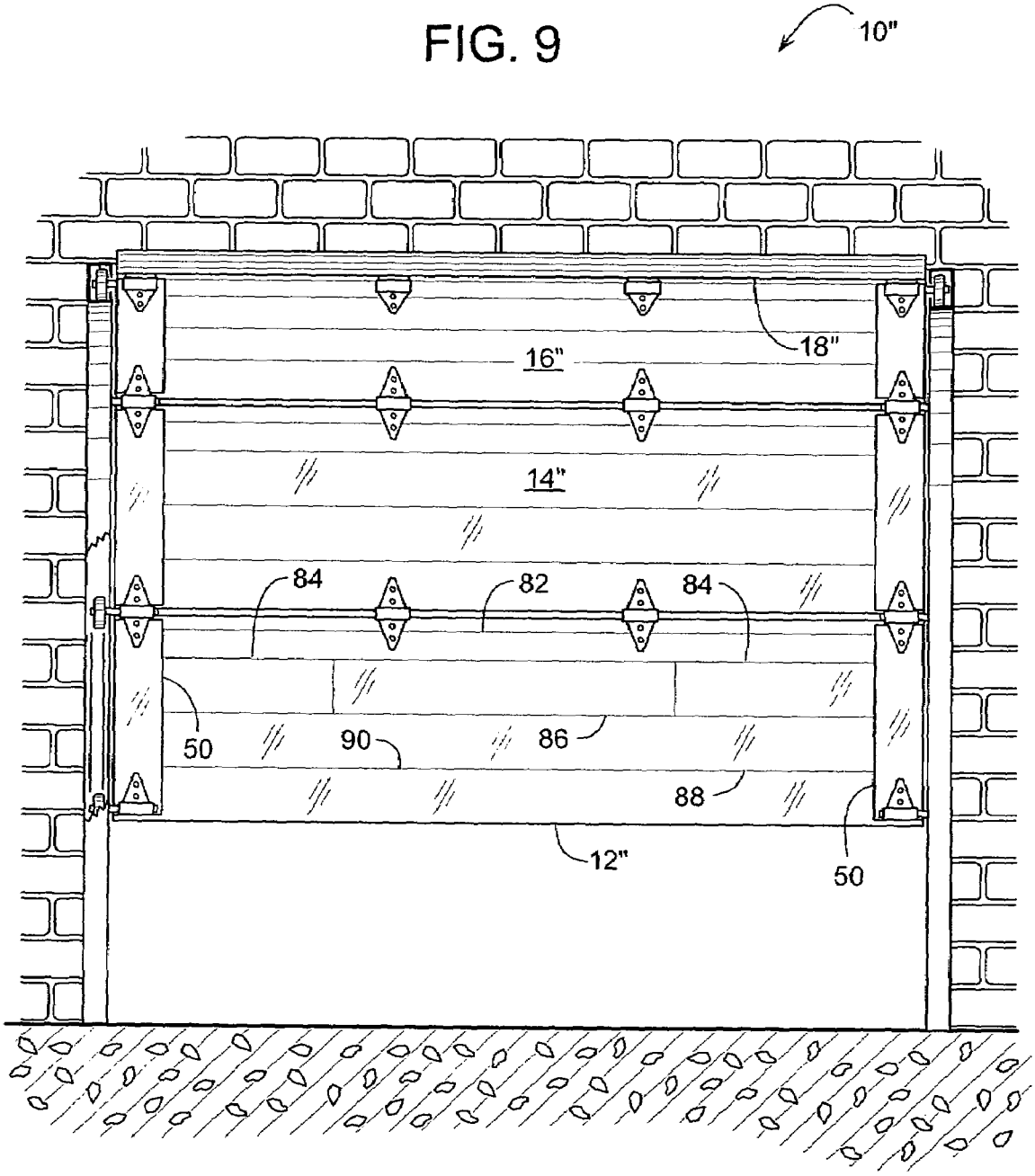
FIG. 9 is similar to FIG. 1, but showing another embodiment of a door panel.

In some cases, a door panel may include one or more panel members with different levels of transparency. In FIG. 9, for example, a door 10" includes a door panel 12" comprising opaque panel members 82 and 84, transparent panel members 86 and 88, and a translucent panel member 90. Transparent panels 86 and 88 serve as windows, and translucent panel 90 allows some light to pass, but provides more privacy that what is provided by panels 86 and 88. For door 10", panels 14", 16" and 18" are of a construction similar to that of panel 12 of door 10.

The door panel thus described, formed from interconnected door panel members, may advantageously be used as a replacement panel for the bottom panel of a sectional door. At the same time, the resulting door panel may be used to replace any other door panel. Finally, the entire door may be formed of such panels.

Figure 10:
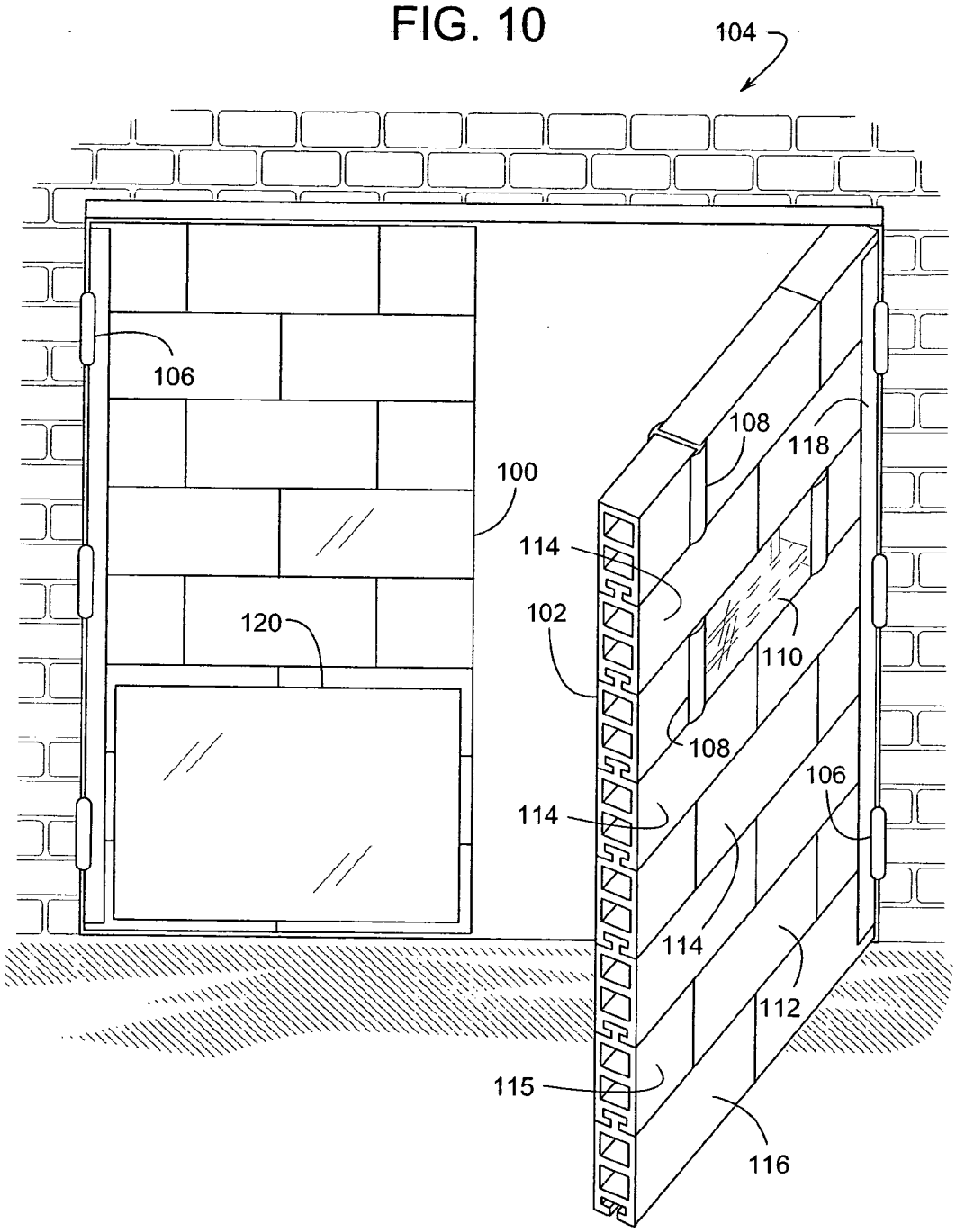
FIG. 10 is a perspective view of another door having extruded panel members.

In FIG. 10, for example, a swinging impact door 104 includes two swinging door panels 100 and 102 whose various component panel members are of a modular construction. The term, "modular" refers to a door panel whose component panel members are interchangeable to create a complete door panel whose material properties or physical characteristics may vary across the door panel. The variations may exist horizontally along the length of the door panel, vertically along the width of the door panel, and/or across the door panel's thickness.

Hinges 106, which mount door panels 100 and 102 to the vertical edges of the doorway, are conventional double-acting, spring-return hinges. The hinge's double-acting feature allows the panels to be swung open in either direction, and the spring-return feature automatically returns the panels to their normally closed position across the doorway.

The component panel members can be of various lengths or cut to size and assembled to create various sized door panels. Connectors 108 (which are represented schematically by way of example and not limitation) can be used to improve the strength or appearance at certain joints.

To provide a door panel with certain desired physical characteristics, the component panel members can be extruded or otherwise produced from a material having one or more material properties that may differ from one panel member to another. In some cases, the material property may even vary within a single panel member, which can be accomplished in various ways including, but not limited to, a co-extrusion process. Co-extrusion is the joining of two dissimilar materials that are chemically similar enough to allow a thermal bond to take place during the extrusion process. As a typical example, flexible PVC and rigid PVC can be co-extruded. Another example is using thermoplastic elastomers and other polymers in combination for windshield wiper blades. Separately extruding different panel members of different materials or providing a single non-homogeneous panel member whose material properties vary from one area of the panel member to another can provide a door panel with well-placed physical characteristics.

For example, a lower portion of door panels 100 and 102 may need greater toughness, tensile strength, wear resistance, hardness, and flexibility to be able to withstand greater or more frequent impacts than the upper portion of the door; the outside surface of the door panels may need greater resistance to water and ultraviolet light; certain component panel members, such as panel member 110, may need to be transparent to provide door panel 102 with a window; some areas of the door panel may require a rougher surface finish for greater bonding ability so hardware, or other items may be glued to the surface of the door panel; some applications require door panels having a certain range of temperature tolerance or thermal conductivity; and it may desirable to have a door panel with component panel members of different colors.

This means that a component door panel member 112 may be distinguishable from another component door panel member 114 or 115 by one or more material properties including, but not limited to, toughness (impactability), flexibility, tensile strength, hardness, wear resistance, ability to transmit light, color, ultraviolet light tolerance, surface finish, water resistance, range of temperature tolerance, thermal conductivity, and/or bonding ability. In some cases, a door panel 116 may be non-homogeneous regarding one or more material properties including, but not limited to, toughness (impactability), flexibility, tensile strength, hardness, wear resistance, ability to transmit light, color, ultraviolet light tolerance, surface finish, water resistance, range of temperature tolerance, thermal conductivity, and/or bonding ability.

In some cases, a component panel member, such as window member 110, can be replaced by a component panel member 110' that includes a screen 122 as shown in FIGS. 11 and 12. Screen 122 can be sandwiched between two frames 124 that may include one or more cross-members 132 that help support screen 122. To hold the frames in place, two end caps 126 can be welded to frames 124. End caps 126 also serve to replace connectors 108. An upper flange 128 and a lower flange 130 allow panel member 110' to interlock with adjacent panel members 114 as shown in FIG. 12. In some cases, a pivotal cover 134 can be added to selectively open or close the screen opening in the door.

To provide door panels for various applications, a door manufacturer may extrude or otherwise produce a plurality of component panel members that have different material properties. After determining one or more desired characteristics of a particular door panel, certain component panel members may be selected from the plurality of component panel members and interconnected to create the desired door panel. In some cases, a door panel may be strengthened or stiffened by attaching a channel 118 (similar to sheet metal end caps 50 of FIGS. 1 and 3). For greater resistance to impact, a wear plate or tough coating 120 (e.g., a bed liner coating commonly used for lining the bed of a pickup truck) can be attached to the face of door panel 100.

Although the invention is described with reference to a preferred embodiment, it should be appreciated by those skilled in the art that various modifications are well within the scope of the invention. For example, the same concepts described with reference to the door of FIG. 10 can be applied to the doors of FIGS. 1 and 9, and vice versa. Therefore, the scope of the invention is to be determined by reference to the claims that follow.

The invention claimed is:

1. A modular sectional door comprising:

a first door panel comprising:

a first sub-panel member comprising a first material;

a first interlocking member disposed on the first sub-panel member, wherein the first sub-panel member and the first interlocking member comprise a first unitary piece;

a second sub-panel member comprising a second material; and a second interlocking member disposed on the second sub-panel member, wherein the second sub-panel member and the second interlocking member comprise a second unitary piece, and wherein the first interlocking member and the second interlocking member interlock with each other to prevent rotation of the first sub-panel member relative to the second sub-panel member; and a second door panel pivotally connected to the first door panel.

2. The modular sectional door of claim 1, wherein the first material is distinguishable from the second material by a material property of the first material and the second material.

3. The modular sectional door of claim 2, wherein the material property is toughness.

4. The modular sectional door of claim 2, wherein the material property is flexibility.

5. The modular sectional door of claim 2, wherein the material property is tensile strength.

6. The modular sectional door of claim 2, wherein the material property is hardness.

7. The modular sectional door of claim 2, wherein the material property is wear resistance.

8. The modular sectional door of claim 2, wherein the material property is the ability to transmit light.

9. The modular sectional door of claim 2, wherein the material property is color.

10. The modular sectional door of claim 2, wherein the material property is ultraviolet light tolerance.

11. The modular sectional door of claim 2, wherein the material property is surface finish.

12. The modular sectional door of claim 2, wherein the material property is water resistance.

13. The modular sectional door of claim 2, wherein the material property is range of temperature tolerance.

14. The modular sectional door of claim 2, wherein the material property is thermal conductivity.

15. The modular sectional door of claim 2, wherein the material property is bonding ability.

16. The modular sectional door of claim 1, wherein the first panel member is non-homogeneous regarding a material property of the first material.

17. The modular sectional door of claim 16, wherein the material property is toughness.

18. The modular sectional door of claim 16, wherein the material property is flexibility.

19. The modular sectional door of claim 16, wherein the material property is tensile strength.

20. The modular sectional door of claim 16, wherein the material property is hardness.

21. The modular sectional door of claim 16, wherein the material property is wear resistance.

22. The modular sectional door of claim 16, wherein the material property is the ability to transmit light.

23. The modular sectional door of claim 16, wherein the material property is color.

24. The modular sectional door of claim 16, wherein the material property is ultraviolet light tolerance.

25. The modular sectional door of claim 16, wherein the material property is surface finish.

26. The modular sectional door of claim 16, wherein the material property is water resistance.

27. The modular sectional door of claim 16, wherein the material property is range of temperature tolerance.

28. The modular sectional door of claim 16, wherein the material property is thermal conductivity.

29. The modular sectional door of claim 16, wherein the material property is bonding ability.

30. The modular sectional door of claim 1, wherein the second door panel comprises:

a third sub-panel member;

a third interlocking member disposed on the third sub-panel member, wherein the third sub-panel member and the third interlocking member comprise a third unitary piece;

a fourth sub-panel member; and a fourth interlocking member disposed on the fourth sub-panel member, wherein the fourth sub-panel member and the fourth interlocking member comprise a fourth unitary piece, and wherein the third interlocking member and the fourth interlocking member interlock with each other to prevent rotation of the third sub-panel member relative to the fourth sub-panel member.

31. A method of producing a modular sectional door comprising:

determining a desired characteristic of a first door panel;

producing a first plurality of modular sub-panel members;

producing a second plurality of modular sub-panel members that are interchangeable with the first plurality of modular sub-panel members, wherein the first plurality of modular sub-panel members are distinguishable from the second plurality of modular sub-panel members by a material property of the first plurality of sub-panel members and the second plurality of sub-panel members;

based on the desired characteristic of the first door panel, selecting a first sub-panel member from the first plurality of sub-panel members;

based on the desired characteristic of the first door panel, selecting a second sub-panel member from the second plurality of sub-panel members; and connecting the first sub-panel member to the second sub-panel member to form the first door panel, such that the first sub-panel member and the second sub-panel member are constrained against rotation relative to each other; and connecting the first door panel to a second door panel, such that the first door panel may rotate relative to the second door panel.

32. The method of claim 31, wherein the first plurality of modular sub-panel members and the second plurality of modular sub-panel members are hollow.

33. The method of claim 31, wherein the first sub-panel member includes a screen.

34. The method of claim 31, wherein the material property is toughness.

35. The method of claim 31, wherein the material property is flexibility.

36. The method of claim 31, wherein the material property is tensile strength.

37. The method of claim 31, wherein the material property is hardness.

38. The method of claim 31, wherein the material property is wear resistance.

39. The method of claim 31, wherein the material property is the ability to transmit light.

40. The method of claim 31, wherein the material property is color.

41. The method of claim 31, wherein the material property is ultraviolet light tolerance.

42. The method of claim 31, wherein the material property is surface finish.

43. The method of claim 31, wherein the material property is water resistance.

44. The method of claim 31, wherein the material property is range of temperature tolerance.

45. The method of claim 31, wherein the material property is thermal conductivity.

46. The method of claim 31, wherein the material property is bonding ability.

47. The method of claim 31, wherein the step of producing the first plurality of modular sub-panel members involves extruding the first plurality of modular sub-panel members.

48. The method of claim 47, wherein the step of producing the second plurality of modular sub-panel members involves extruding the second plurality of modular sub-panel members.

49. A modular sectional door comprising:

a first door panel comprising:

a first sub-panel member comprising of a first material;

a second sub-panel member comprising of a second material, wherein the first material is distinguishable from the second material by a material property of the first material and the second material; and a connector interposed between the first panel member and the second panel member to prevent pivotal movement of the first sub-panel member relative to the second sub-panel member; and a second door panel hingedly connected to the first door panel.

50. The modular sectional door of claim 49, wherein the material property is toughness.

51. The modular sectional door of claim 49, wherein the material property is flexibility.

52. The modular sectional door of claim 49, wherein the material property is tensile strength.

53. The modular sectional door of claim 49, wherein the material property is hardness.

54. The modular sectional door of claim 49, wherein the material property is wear resistance.

55. The modular sectional door of claim 49, wherein the material property is the ability to transmit light.

56. The modular sectional door of claim 49, wherein the material property is color.

57. The modular sectional door of claim 49, wherein the material property is ultraviolet light tolerance.

58. The modular sectional door of claim 49, wherein the material property is surface finish.

59. The modular sectional door of claim 49, wherein the material property is water resistance.

60. The modular sectional door of claim 49, wherein the material property is range of temperature tolerance.

61. The modular sectional door of claim 49, wherein the material property is thermal conductivity.

62. The modular sectional door of claim 49, wherein the material property is bonding ability.

63. The modular sectional door of claim 49, wherein the first panel member is non-homogeneous regarding a material property of the first material.

* * * * *